United States Patent [19]

Royle et al.

[11] Patent Number: 4,997,234

[45] Date of Patent: Mar. 5, 1991

[54] ROCKER-RECLINER CHAIR

[75] Inventors: John A. Royle, Paramount; Lawrence M. Stinchfield, Fullerton, both of Calif.

[73] Assignee: Stinchfield Enterprises, Inc., Paramount, Calif.

[21] Appl. No.: 350,548

[22] Filed: May 11, 1989

[51] Int. Cl.[5] ..... A47C 3/02

[52] U.S. Cl. ..... 297/258; 297/440

[58] Field of Search ..... 297/258, 271, 440, 397, 297/284

[56] References Cited

U.S. PATENT DOCUMENTS

| | | | |
|---|---|---|---|
| 763,667 | 6/1904 | Hokans . | |
| 953,338 | 3/1910 | Hurd | 297/258 X |
| 2,587,196 | 2/1952 | Morecroft | 297/397 X |
| 2,738,001 | 3/1956 | Drabert | 297/440 X |
| 3,026,143 | 3/1962 | Kundtz et al. | 297/258 |
| 3,099,477 | 7/1963 | O'Herron | 297/258 X |
| 3,719,389 | 3/1973 | Burton et al. | 297/440 |
| 4,109,960 | 8/1978 | Stinchfield | 297/258 |
| 4,213,650 | 7/1980 | Sroub | 297/440 X |
| 4,522,444 | 6/1985 | Pollock . | |
| 4,674,795 | 6/1987 | Nelson . | |
| 4,786,105 | 11/1988 | Sheehan et al. . | |
| 4,790,596 | 12/1988 | Shifferaw | 297/258 X |

FOREIGN PATENT DOCUMENTS

| | | | |
|---|---|---|---|
| 140073 | 4/1903 | Fed. Rep. of Germany | 297/258 |

*Primary Examiner*—José V. Chen

*Attorney, Agent, or Firm*—Thomas Schneck; Terry McHugh

[57] ABSTRACT

A chair capable of rocking and reclining is provided with a contoured seat and an external frame assembly for maintaining the contoured seat above the ground. The external frame assembly has a pair of spaced-apart tubular side members with a continuous outer periphery forming a loop. Each of the tubular side members has a large, ground-contacting arcuate region that extends for approximately 90 degrees and an arm support region that forms an arm rest. The tubular side members are coupled together by cross members that extend between the two. The contoured seat fits between the side members and rests upon the cross members. A user is comfortably positioned in the chair by head, back and seat support areas of the contoured seat. The contoured seat and curvature of the arcuate regions have a relationship such that the axis of curvature of the arcuate regions is slightly rearward of the center of gravity of an occupied chair, thereby allowing the user to comfortably change or maintain the position of the chair over a wide degree of positions.

26 Claims, 4 Drawing Sheets

ROCKER-RECLINER CHAIR

DESCRIPTION

1. Technical Field

The present invention relates to rocking chairs and more particularly to rocking chairs which also recline due to external structure.

2. Background Art

Various types of chairs have been developed which either rock, recline or do both. A first type of a chair that rocks and reclines has a conventional design in which a seat with extending legs is attached to a pair of curved rails. An example of this first type of rocking-reclining chair is shown in U.S. Pat. No. 763,667 to Hokans. The chair disclosed by Hokans follows the conventional design by having a pair of rocking rails attached to a seat. The rails of Hokans are of unusual length so that one may rock or lean back in the chair without falling backwards. While the chair of Hokans makes the likelihood of falling backwards less likely than chairs of this type having shorter rails, the possibility still exists. Sheehan et al. in U.S. Pat. No. 4,786,105 shows a modified form of this first type of rocking-reclining chair in which a tubular metal frame forms the rails and support structure for adjustable seat and back cushions.

Rocking chairs of this first type have the disadvantage of having abrupt ends to the rails, which may pose a safety hazard, especially to small children. Another disadvantage to rocking chairs of this type is seen when the chair is leaned backwards. As one leans back in the chair the weight of the person is shifted from the seat to the back of the chair and the back section of the rails, thus setting up a force couple. This couple may create large shear stresses in the chair elements which could lead to failure of the chair. Furthermore, chairs of this type may tip over backwards.

A second type of rocking-reclining chair has a fixed base coupled to a seat through a spring. This type of rocking-reclining chair is exemplified by U.S. Pat. No. 4,674,795 to Nelson, and U.S. Pat. No. 4,522,444 to Pollock. These two patents show a chair having a seat that is supported by a flexible frame which allows for rocking and reclining actions. A characteristic of this second type of rocking-reclining chair is that an increased force is required to further recline the chair, thus leading to a limited degree to which the chair may comfortably recline.

A third type of rocking-reclining chair has a molded outer contour to the seat giving it a rocking and reclining action. A weight is located within the chair for upright stability. An example of this type of chair may be found in U.S. Pat. No. 4,109,960, to Stinchfield. Such a chair is highly desirable for persons who find it comfortable and fashionable to sit close to the floor. However, low profile furniture does not fit well with all decors.

It is therefore an object of the present invention to provide a comfortable, rocking-reclining chair which is suitable in appearance for a wide range of decors. It is another object of the present invention to provide a rocking-reclining chair which is easy to use and adapted to recline to a wide degree of positions selected by the user and remain in the selected reclining position without significant effort on the part of the user. This invention has the further object of providing a rocking-reclining chair which is safe, sturdy and structurally sound.

SUMMARY OF THE INVENTION

The above objects have been met by a chair having a raised seating surface with an inner contour molded to conform to a body and maximize the comfort and seating stability of the user, and having a pair of continuous, non-ending external frame elements that are coupled together to form a support frame for supporting the seating surface. Each of the continuous frame elements, called side frame members, forms a side of the chair which are connected to each other by cross members. The seating surface or seating platform fits snugly between the sides and is supported off of the ground by the cross members.

Each of the continuous side frame members has a large arcuate region which extends approximately 90 degrees or more from the front to the rear of the chair. The arcuate regions contact the ground and provide the rocking and reclining capabilities of the chair. The radius of curvature of each arcuate region is relatively constant for a large extent of the arcuate region beginning at the front of the chair. After the section of constant curvature, the radius of curvature of the arcuate region gradually increases rearwardly. The overall curvature of the arcuate regions is designed such that the center of gravity of a seated person in the chair falls slightly forward the axis of curvature of the arcuate regions. Little effort is required on the part of the user to rock or recline the chair, since the axis of curvature of the arcuate regions remains slightly rearward but still near the center of gravity of an occupied chair, much like a slightly off-balanced teetertotter. A user may by positioning his arms or legs adjust the center of gravity to coincide with the axis of curvature, resulting in an equilibrium position. The chair is prevented from falling backwards from such an equilibrium position by the section of the arcuate region having an increasing radius of curvature. Thus, the chair will have a slight tendency to come upright, which tendency is easily overcome by a slight force from the legs of the user or by a slight repositioning of the user. Therefore, various sized and shaped persons can use the chair with equal comfort, and only slight movement of the user's arms or legs is needed to initiate rocking or to change a reclined position. No adjustments are required to accommodate a wide range of body sizes.

Each side frame member has an outer periphery which forms a continuous loop. The above-described arcuate region is a ground-engaging region which is coupled at opposite ends to the opposite ends of an armsupporting region by intermediate regions. A side frame member may be formed by a single tubular member or by multiple pieces, as long as the end result is a smooth continuous frame.

To support cross members and further strengthen the frame, brace members extend between the inner periphery of a side frame member. Some of the brace members support cross members from one side of the chair to the other. An advantage of the present invention is that the continuous side frame provides a sturdy structure. The high shear stresses typically associated with rocking-reclining chairs having force couples do not occur in the present invention, because no force couples are set up due to the continuous nature of the side frames. Moreover, the external support frame distributes the load of a user about the frame in a similar fashion to an exoskeleton, thereby providing the present chair with exceptional structural integrity. Another advantage is that the support frame maintains the user comfortably above the floor surface so that the user may easily get in and out of the chair.

Preferably a weight is placed in the front of the chair, to maintain the chair in an upright position and to reduce the amount of floor space the chair occupies when not in use. The weight may be placed in the seating portion of the seating platform or within the frame.

The continuous nature of the side frame member offers the further advantage of not having any abrupt ends which can pose a safety hazard. Moreover, because the arcuate regions of the side members extend over a wide degree, the chair is able to lie nearly flat to the ground without falling backwards.

BEST MODE FOR CARRYING OUT THE INVENTION

Figure 1:
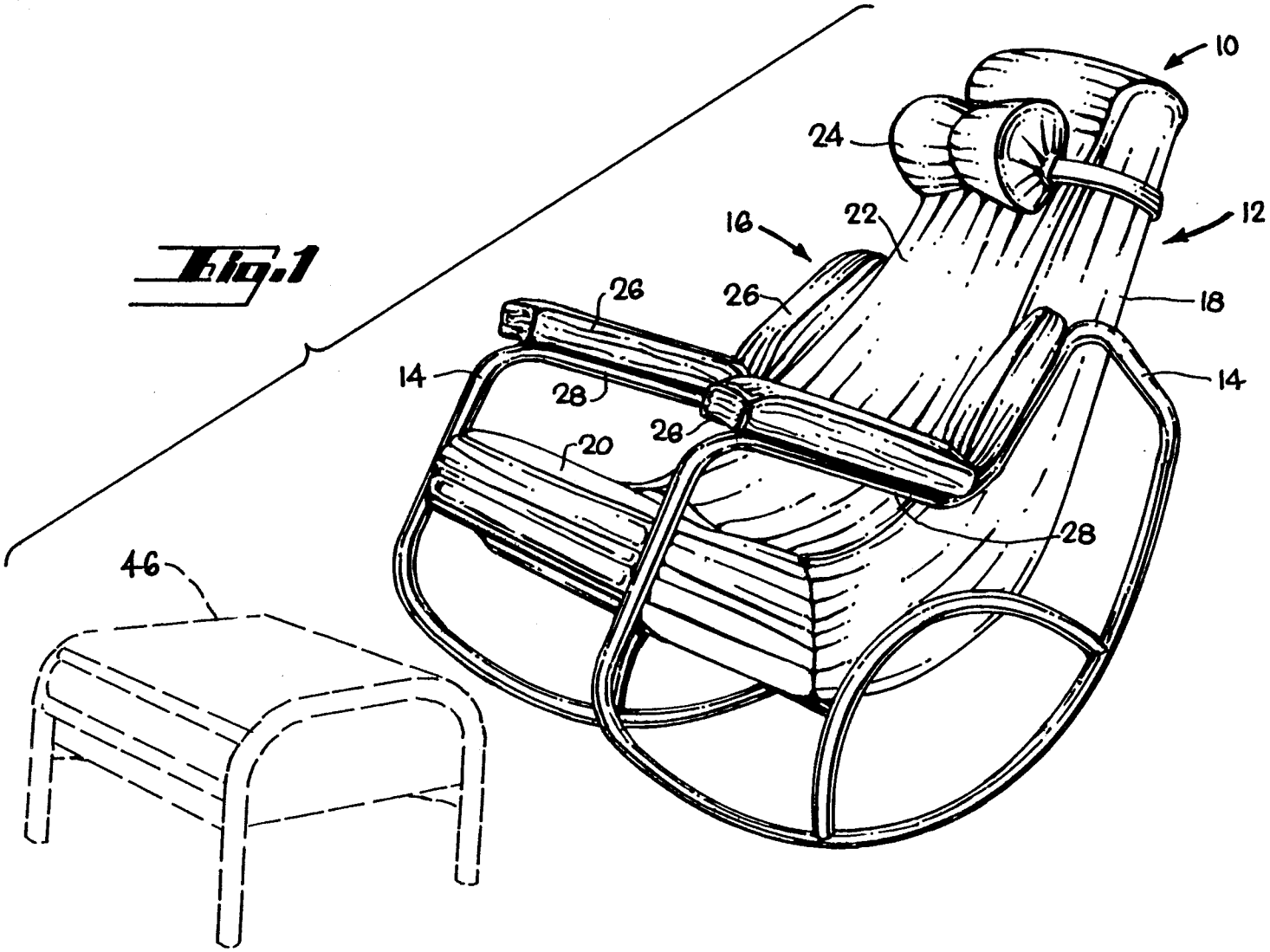
FIG. 1 is a perspective view of a chair in accordance with the present invention.

Referring to FIG. 1, a chair 10 is shown having a seating platform 12 raised and maintained above the ground by an external support frame 14. The external support frame 14 is preferably made from hollow metal tubes to form a tubular framework. Other materials may also be used, such as wood, plastic or rattan. The word tubular is meant to include various outer shapes such as octagonal, hexagonal, oval, square, circular, etc., as long as there is a hollow. The seating platform 12 has an inner contour 16 that is molded to conform to the body of a seated person, and an outer surface 18 for contacting the support frame 14. The inner contour 16 comprises a smoothly curved seat portion 20 and a smoothly curved upright portion 22 connected to the seat portion 20. The upright portion 22 has a sufficient length to provide head and back support to a user, while the seat portion 20 conforms and supports the seat of the user. An optional neck pillow 24 is adjustably attached to the upright portion 22 by an elastic band.

The seating platform 12 is an integral member and may be made by any of the known methods in the art. The seating platform 12 may be covered with fabric, leather or other suitable material. For outdoor use, the seating platform should be made of a durable material, such as plastic or wood. Arm pads 26 are attached to the arm rests 28 formed by the support frame 14.

A hassock or foot rest 46 is also shown in FIG. 1, but it is not a part of the present invention. The hassock 46 may be used to increase the comfort of a user or facilitate reclining, as is discussed more fully in relation to FIG. 7.

Figure 2:
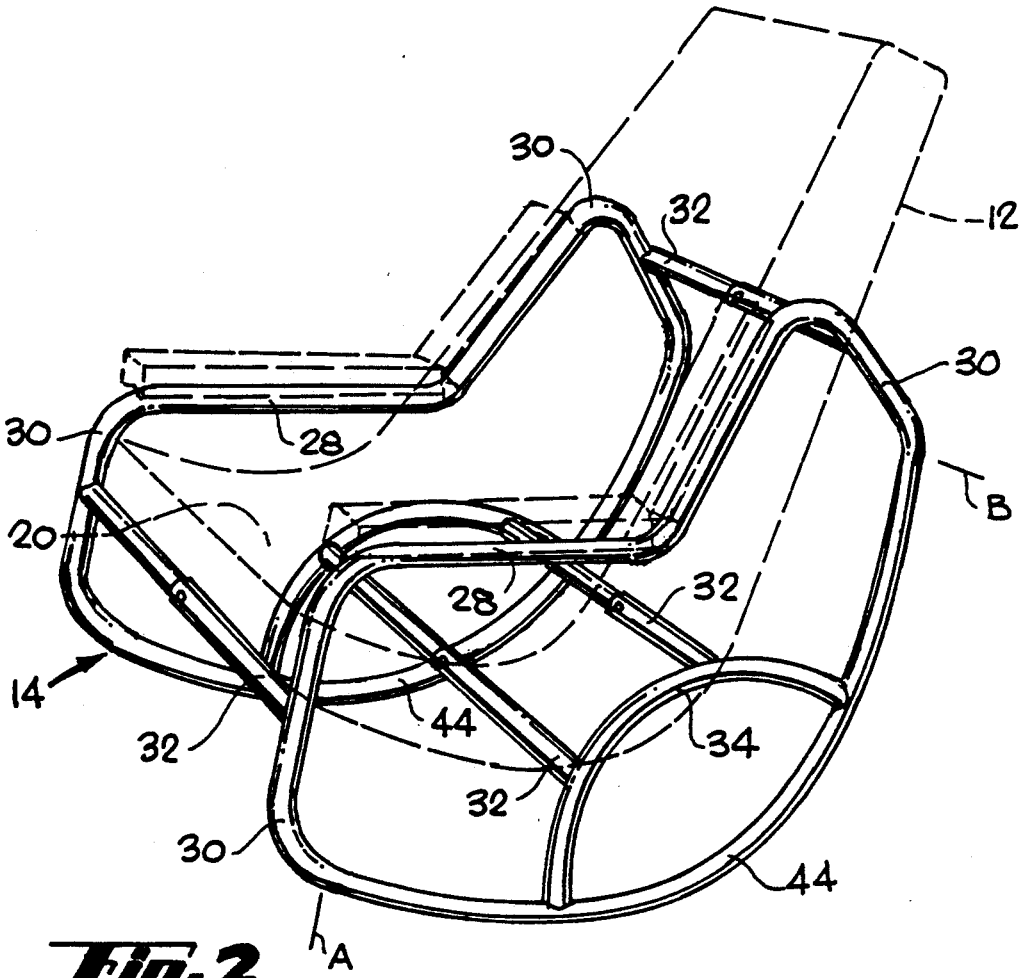
FIG. 2 is a perspective view of the support frame of FIG. 1 with the seating platform shown in phantom.

Turning now to FIG. 2 the support frame 14 is shown to have a pair of side frame members 30. The side frame members 30 are spaced apart and coupled together by cross members 32. A curved brace member 34 is shown to support two of the cross members 32. Each side frame member 30 has a corresponding continuous outer periphery that is smoothly divided into various regions. One of these regions is an arcuate region 44 extending between lines A and B. The arcuate regions 44 have generally a forward section with a constant radius of curvature that extends rearward for much of the arcuate region followed by a rearward section having a rearwardly increasing radius of curvature. The arcuate region and seating platform are designed to place the axis of curvature close to, but slightly rearward the center of gravity of the chair and a seated person. Another region of the side frame members 30 is the arm rests 28. The arm rests 28 are generally spaced a distance above the seat portion 20 of the seating platform 12.

Figure 3:
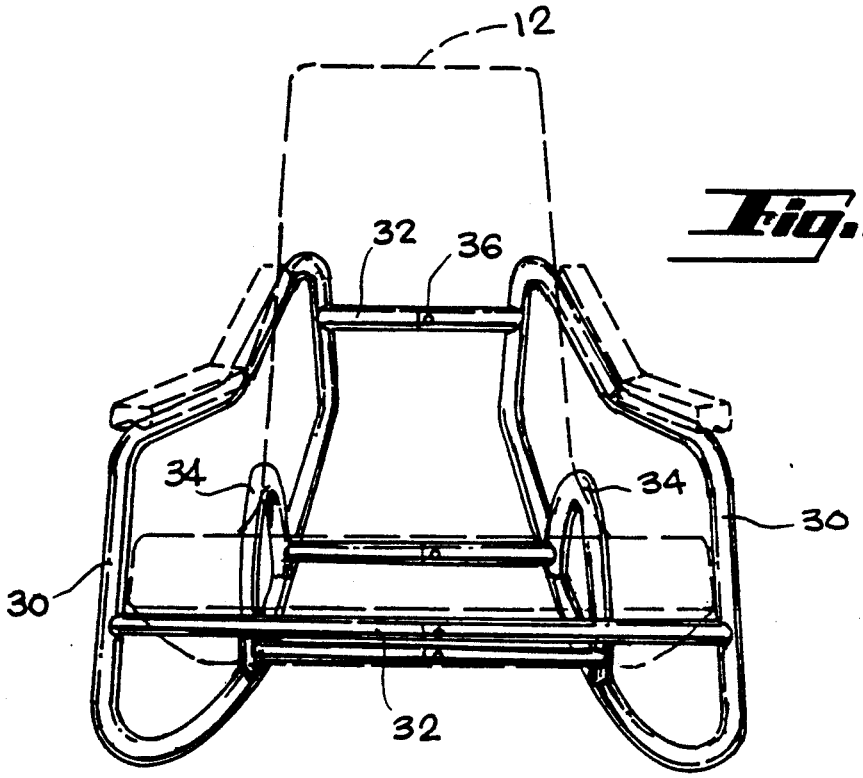
FIG. 3 is a front view of the support frame of FIG. 2.
Figure 4:
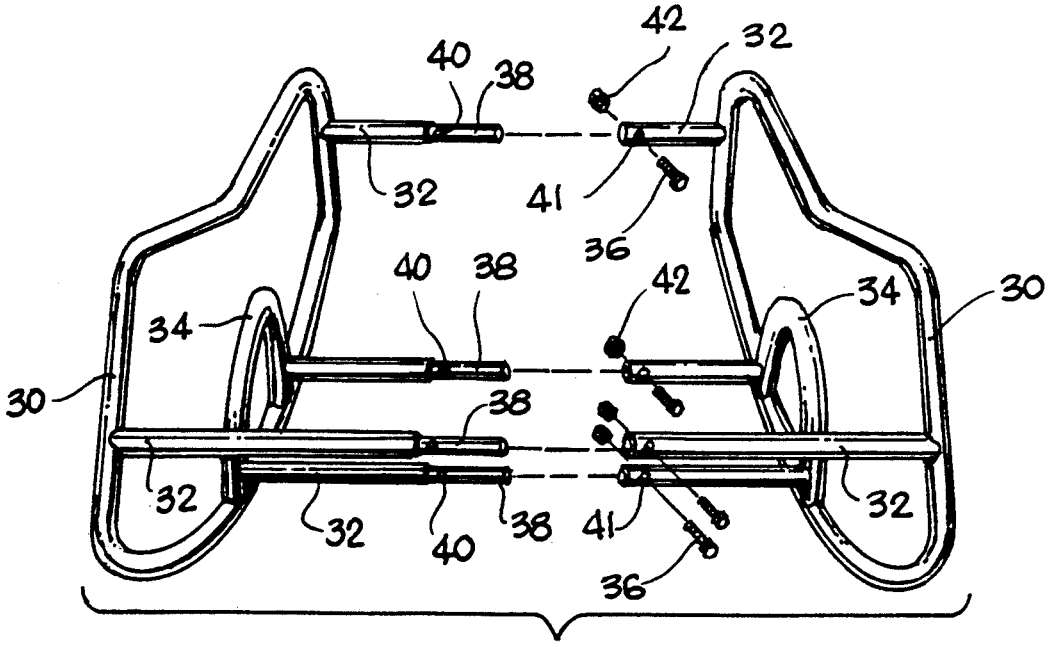
FIG. 4 is an exploded view of the support frame of FIG. 3.

Referring now to FIGS. 3 and 4, it is seen that seating platform 12 fits between side frame members 30 and rests upon the cross members 32. Side frame members 30 may be separated by removing screws 36 from the cross members 32. Each cross member 32 is divided into corresponding halves, with each half associated with a particular side frame 30, but this is not critical. The side frame members are coupled together by having one of the cross member halves include a small diameter extension 38 with a mating hole 40. A corresponding hole 41 is found on the opposite half. The extension 38 mates with the corresponding half by fitting within the hollow of that corresponding half, and is secured by the screw 36 which penetrates corresponding holes 40 and 41 in both halves. The screw 36 engages with a nut 42 for tightening or loosening.

An alternative method for joining the two side frames together is to have the cross members as separate pieces which fit over short, stubby extensions of the side frames. The separate cross members would be joined and secured to the extensions with screws, as described previously, or by other fastener means. Other alternative methods of joining the side frames may also be used, such as permanently joining the cross members to the side frames by welding, gluing, or strappping. Strapping is particularly useful when the frame members are made of rattan or wood.

Figure 5:
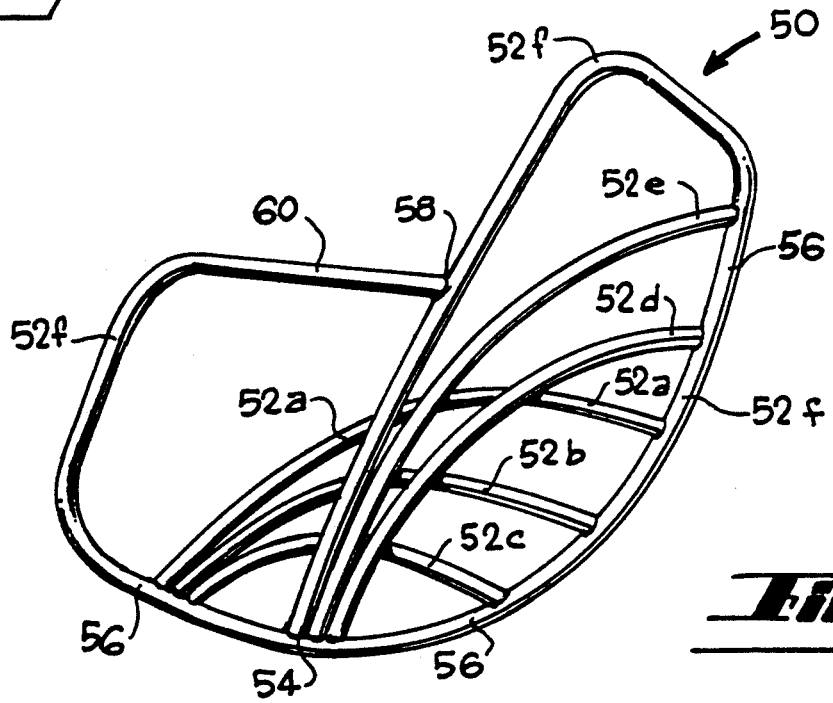
FIG. 5 is a side view of a second embodiment of a side frame member in accordance with the present invention.

FIG. 5 shows a second embodiment of a side frame member 50 having a plurality of tubular members 52. The outer periphery of the side frame member 50 is similar to that of the side frame members 30 shown and described in the previous figures. Tubular member **52*f* forms the outer periphery of the side frame 50. The tubular member 52*f* has ends which are connected back onto itself. Beginning with end 54, the tubular member 52*f* has a first upward extension which smoothly bends rearwardly and then downwardly to form an arcuate region 56 at the rear and bottom of the side frame 50. The arcuate region 56 has a fairly constant radius of curvature and extends in an arc of about 90 degrees. After the arcuate region 56, the tubular member 52*f* smoothly bends upwardly at the front of the side frame and then rearwardly to form an arm rest 60. The second end 58 attaches to the tubular member 52*f* about halfway up the first upward extension, thereby forming a continuous outer periphery of the side frame member 50**.

Figure 6:
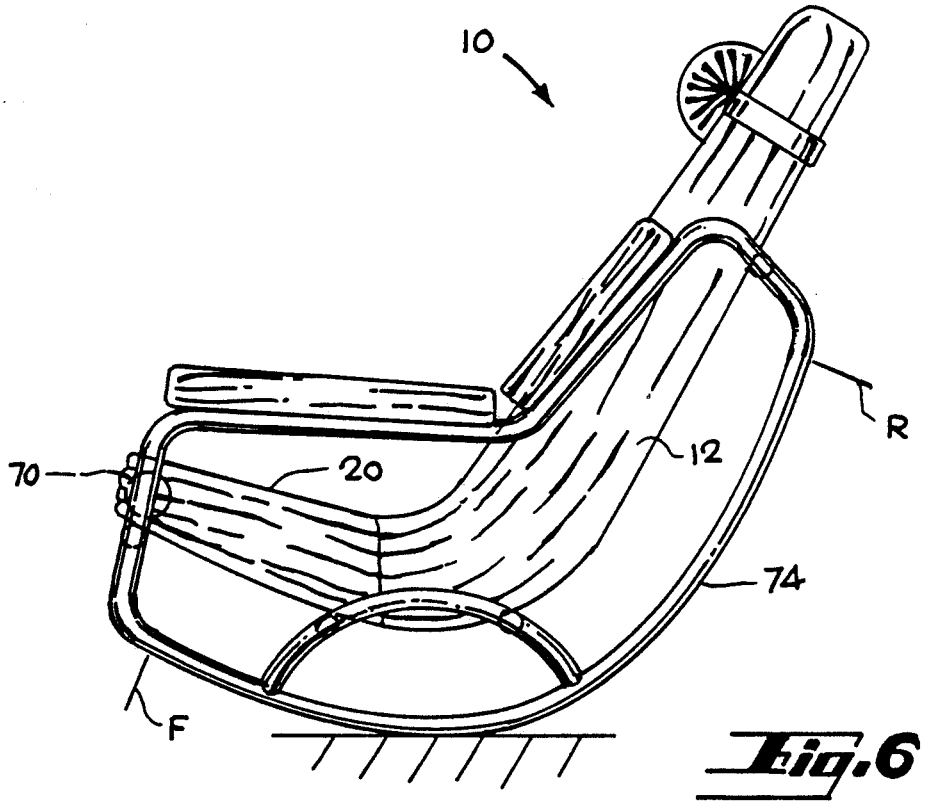
FIG. 6 is a side view of the chair of FIG. 1 shown in an upright position.

Tubular members **52*d* and 52*e* are attached to tubular member 52*f* next to end 54 and extend upward until reattaching to the tubular member 52*f* at an upper rear area. The tubular members 52***a–c* are connected, next to each other, to tubular member 52*f* toward the front of the side frame 50. These tubular members 52*a–c* then spread out and reattach to tubular member 52*f* toward the rear and bottom of the side frame 50. The tubular members 52*a–f* form a sturdy side frame. Cross members, not shown, may be connected to some of the tubular members. Neither the arrangement nor the number of these tubular members is critical, so long as a seating platform can be fitted and supported between a pair of side frames. Turning now to FIG. 6, the chair 10 shown in FIG. 1 is shown in an upright position, as one would find the chair when not in use. A weight 70 is located in the front of the seat portion 20. This weight 70 tends to maintain the chair in the upright position as shown. Weights incorporated in the support frame may be used in combination with or in place of the weight 70. For example, cross member 72 may include additional weights. The chair 10 is capable of rocking or reclining within the arcuate region 74 defined between lines F and R.

Figure 7:
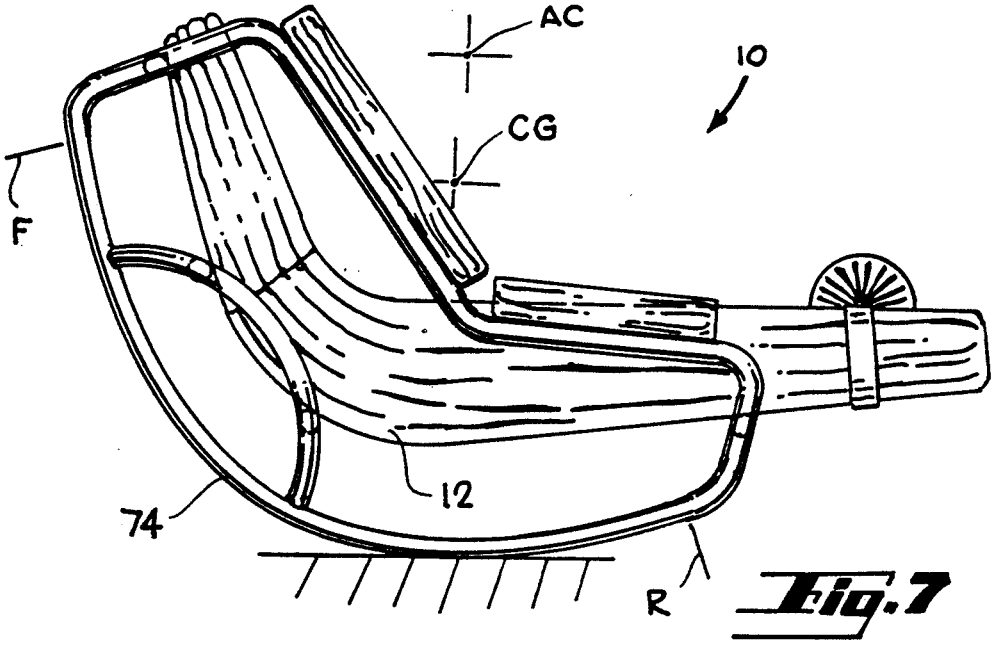
FIG. 7 is a side view of the chair of FIG. 6 shown in a nearly fully reclined position.

FIG. 7 demonstrates a nearly horizontal reclined position. To facilitate a user obtaining this position in the chair 10, a hassock or foot rest, as shown in FIG. 1, or other object is used to elevate the feet and legs of the user and to provide a surface on which the user may apply a force, causing the chair to recline. The user can easily regain an upright position from this reclined position. Furthermore, because the arcuate region extends to the upper rear of the chair 10, with an increasing radius of curvature the chair cannot tip over backwards. The relative ease of operation of the present rocking-reclining chair 10 is due to the natural positioning of the user in the seating platform 12 and the large arcuate region 74. The seating platform 12 positions the user so that the center of gravity CG of the chair and the user is slightly forward of the axis of curvature AC of the arcuate regions. In operation this center of gravity CG remains roughly in the same horizontal plane regardless of the position of the chair. That is, the center of gravity remains about the same distance above the ground despite how much the user reclines, within the limits F and R of the arcuate region 74. Furthermore, the center of gravity CG follows a horizontal path in accord with a change in the position of the chair. That is, when the chair reclines rearward, the center of gravity moves horizontally rearward and vice versa. The axis of curvature AC of the arcuate regions follows a path that is horizontal for the constant radius section and increasingly curved upward for the rearwardly increasing radius of curvature section.

We claim:

1. A rocking-reclining chair comprising, a seating platform having an outer surface and an inner contour, the inner contour having a back-supporting portion and a seat portion, the seat portion having a fixed forward relation with the back-supporting portion, a support frame for maintaining the seating platform in a ground-clearance condition, the support frame having a pair of side frame members in spaced apart relation at opposed sides of the seating platform, each side frame member having a continuous outer periphery having an arm-supporting region and an arcuate ground-engaging region with a forward and a rearward end, each end of the ground-engaging region being coupled to the arm-supporting region in an uninterrupted manner by an intermediate segment, the ground-engaging region having a forward section with a generally constant radius of curvature and a rearward section with a rearwardly increasing radius of curvature, the forward and rearward sections of each ground-engaging region combining to define a smooth arcuate rocking means wherein the back-supporting portion of the seating platform may be moved between an upright, nearly vertical position to a reclined, nearly horizontal position.

2. The rocking-reclining chair of claim 1 wherein each of said side frame members is made of a single-piece construction.

3. The rocking-reclining chair of claim 1 wherein each of said side frame members is made up of a multi-piece construction forming an integral side frame member.

4. The rocking-reclining chair of claim 1 wherein said support frame is tubular.

5. The rocking-reclining chair of claim 1 wherein each of said side frame members has a brace member connected at two inner points of the side frame member.

6. The rocking-reclining chair of claim 1 further comprising a self-righting means located in a forward section of the chair for maintaining the chair in a stable upright position when not in use.

7. The rocking-reclining chair of claim 6 wherein said self-righting means comprises a weight in the forward section of said seat portion.

8. The rocking-reclining chair of claim 6 wherein said self-righting means comprises a weight in the support frame.

9. The rocking-reclining chair of claim 1 wherein said side frame members are separable from one another.

10. The rocking-reclining chair of claim 1 wherein said back-supporting portion of the seating platform further comprises a head support extension for supporting the head and neck of a seated person.

11. The rocking-reclining chair of claim 10 further comprising an adjustable neck support means adjustably located along said back-supporting portion of the seating platform.

12. The rocking-reclining chair of claim 1 wherein said support members are cross members which connect to both side frame members.

13. A rocking-reclining chair comprising, a seating platform having an outer surface and an inner contour having a rearward back-engaging portion extending upwardly a sufficient length to provide head support, the inner contour further having a forward seat portion integral with the back-engaging portion, a tubular support frame for supporting the seating platform, the tubular support frame having an upright position wherein said back-engaging portion is generally vertical and having including means to allow movement of said back-engaging portion between a reclined position wherein said means to allow said back-engaging portion is generally horizontal, movement defined by the tubular support frame a pair of side frame members spaced apart by the seating platform, the side frame members being fixed with respect to the seating platform, each side frame member having a continuous outer periphery, the continuous outer periphery of each side frame member being partially defined by an arcuate ground-engaging region and an arm-supporting region, the ground-engaging region coupled to the arm-supporting region at a front end by a first intermediate region and at a back end by a second intermediate region, the ground-engaging region having a forward section with a generally constant radius of curvature and a rearward section with a rearwardly increasing radius of curvature, the rearward section extending behind said back-engaging portion of the seating platform such that a force applied to said chair displaces said tubular support frame from said upright position to said reclined position.

14. The rocking-reclining chair of claim 13 wherein each of said side frame members is made of a single-piece construction.

15. The rocking-reclining chair of claim 13 wherein each of said side frame members is made of a multi-piece construction forming an integral side frame member.

16. The rocking-reclining chair of claim 13 wherein said tubular support frame includes cross members joining said side frame members, each of said side frame members having a brace member spanning between said outer periphery and connecting to the side frame member at two separate points for locating and supporting a cross member.

17. The rocking-reclining chair of claim 13 further comprising a self-righting means located in a forward section of the chair for maintaining the chair in said upright position when not in use.

18. The rocking-reclining chair of claim 17 wherein said self-righting means comprises a weight in the forward section of said seat portion.

19. The rocking-reclining chair of claim 17 wherein said self-righting means comprises a weight in said support frame.

20. The rocking-reclining chair of claim 13 wherein said side frame members are separably coupled together.

21. The rocking-reclining chair of claim 13 further comprising an adjustable neck support means positionally adjustable along said back-engaging portion of the seating platform.

22. A rocking-reclining chair comprising, an integral seating platform having an outer surface and an inner contour having a rearward backengaging portion, the inner contour further having a seat portion, a support frame for supporting the seating platform in a ground clearance condition, the support frame having a pair of single-piece side frame members in spaced apart relation and releasably coupled together by a plurality of cross members, the support frame supporting the seating platform between the side frame members with the outer surface of the seating platform resting on some of the cross members, each side frame member having a continuous outer periphery having a ground engaging arcuate region and an arm supporting region, each arcuate region extending from the front of the chair to an upper rear of the chair and having a forward section with a generally constant radius of curvature and a rearward section with a rearwardly increasing radius of curvature, the radii of curvature of the arcuate regions defining a range of rocking of the support frame wherein the backengaging portion of the seating platform has a forward rest position nearly perpendicular to the ground and a rearward reclined position nearly parallel to the ground, the center of gravity of the chair following a generally horizontal path through the range of rocking, and uprighting means located in the forward section of the chair for maintaining the chair in the forward rest position when not in use.

23. The rocking-reclining chair of claim 22 wherein each of said side frame members has a plurality of brace members spanning between the inner periphery of said side member.

24. The rocking-reclining chair of claim 22 wherein said uprighting means comprises a means to allow a weight in the forward section of said seat portion of said seating platform.

25. The rocking-reclining chair of claim 22 wherein said uprighting means comprises weights distributed within said support frame.

26. The rocking-reclining chair of claim 22 wherein each of said arcuate regions extends at least 90 degrees.

* * * * *

UNITED STATES PATENT AND TRADEMARK OFFICE

CERTIFICATE OF CORRECTION

PATENT NO. : 4,997,234

DATED : March 5, 1991

INVENTOR(S) : John A. Royle et al.

It is certified that error appears in the above-identified patent and that said Letters Patent is hereby corrected as shown below:

Claim 13 should read as follows:

13. A rocking-reclining chair comprising, a seating platform having an outer surface and an inner contour having a rearward back-engaging portion extending upwardly a sufficient length to provide head support, the inner contour further having a forward seat portion integral with the back-engaging portion, a tubular support frame for supporting the seating platform, the tubular support frame including means to allow movement of said back-engaging portion between an upright position wherein said back-engaging portion is generally vertical and a reclined position wherein said back-engaging portion is generally horizontal, said means to allow movement defined by the tubular support frame having a pair of side frame members spaced apart by the seating platform, the side frame members being fixed with respect to the seating platform, each side frame member having a continuous outer periphery, the continuous outer periphery of each side frame member being partially defined by an arcuate ground-engaging region and an arm-supporting

UNITED STATES PATENT AND TRADEMARK OFFICE

CERTIFICATE OF CORRECTION

PATENT NO. : 4,997,234

DATED : March 5, 1991

INVENTOR(S) : John A. Royle et al.

It is certified that error appears in the above-identified patent and that said Letters Patent is hereby corrected as shown below:

region, the ground-engaging region coupled to the arm-supporting region at a front end by a first intermediate region and at a back end by a second intermediate region, the ground-engaging region having a forward section with a generally constant radius of curvature and a rearward section with a rearwardly increasing radius of curvature, the rearward section extending behind said back-engaging portion of the seating platform such that a force applied to said chair displaces said tubular support frame from said upright position to said reclined position.

Signed and Sealed this

Eighth Day of September, 1992

*Attest:*

DOUGLAS B. COMER

*Attesting Officer*

*Acting Commissioner of Patents and Trademarks*